US009795262B2

(12) United States Patent
Bosses

(10) Patent No.: US 9,795,262 B2
(45) Date of Patent: Oct. 24, 2017

(54) REMOVABLE TOOL CADDY

(71) Applicant: Zenith Technologies, LLC, Fort Lauderdale, FL (US)

(72) Inventor: Mark D. Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 324 days.

(21) Appl. No.: 14/734,227

(22) Filed: Jun. 9, 2015

(65) Prior Publication Data

US 2015/0351598 A1 Dec. 10, 2015

Related U.S. Application Data

(60) Provisional application No. 62/009,645, filed on Jun. 9, 2014.

(51) Int. Cl.
*A47L 9/00* (2006.01)

(52) U.S. Cl.
CPC ..... *A47L 9/0018* (2013.01)

(58) Field of Classification Search
CPC .... A47L 9/0018; A47L 9/0036; A47L 9/0027; A47L 9/0009
USPC ..... D32/23, 31
See application file for complete search history.

(56) References Cited

U.S. PATENT DOCUMENTS 2,825,087 A * 3/1958 Meyerhoefer ..... A47L 5/365 15/246.2
3,872,538 A 3/1975 Crouser
5,137,156 A * 8/1992 Riczinger ..... A47L 5/28 15/323
5,303,447 A * 4/1994 McKnight ..... A47L 9/0036 15/246.2
D391,703 S * 3/1998 Miller ..... D32/22
6,070,288 A * 6/2000 Luyckx ..... A47L 9/0027 15/323
6,260,233 B1 * 7/2001 Wareham ..... A47L 9/0009 15/323
6,510,582 B1 * 1/2003 Yoo ..... A47L 9/0009 15/323
6,832,408 B2 12/2004 Roney
7,039,985 B2 5/2006 Hisrich
7,284,297 B2 * 10/2007 Shanor ..... A47L 9/0018 15/246.2
7,350,262 B2 * 4/2008 Scheifele ..... A47L 5/30 15/246.2
2003/0024067 A1 * 2/2003 Roney ..... A47L 9/0009 15/323

(Continued)

*Primary Examiner* — Marc Carlson
(74) *Attorney, Agent, or Firm* — Global IP Counselors, LLP

(57) ABSTRACT

A tool caddy selectively connectable to a surface cleaner, the tool caddy including a base having a first accessory attachment feature, and a stem extending substantially perpendicular from the base and disposed substantially central to the base, the stem having a second accessory attachment feature. A combination surface cleaner and a removable tool caddy including a surface cleaner having a handle, a cord, an upper cord hook, and a lower cord hook, and a removable tool caddy having a base and a stem extending substantially perpendicular from the base and disposed substantially central to the base, the stem including a first opening and a flange for receiving the upper cord hook and a second opening for receiving the lower cord hook.

7 Claims, 13 Drawing Sheets

(56) References Cited

U.S. PATENT DOCUMENTS

2003/0226231 A1* 12/2003 Hisrich ..... A47L 5/32
15/323

* cited by examiner

REMOVABLE TOOL CADDY

RELATED APPLICATION

This application claims the benefit under 35 U.S.C. §119 (e) of U.S. Provisional Patent Application Ser. 62/009,645, filed on Jun. 9, 2014, the disclosure of which is hereby incorporated by reference in its entirety.

FIELD

Various exemplary embodiments of the invention relate to a removable tool caddy for a floor cleaning device.

BACKGROUND

Surface cleaners, for example, upright vacuum cleaners and canister vacuum cleaners are used for cleaning dirt and other debris. Upright vacuum cleaners are typically suited for cleaning floors or similar horizontal surfaces, while canister vacuum cleaners, having a flexible hose, are typically suited to clean other surfaces. Upright vacuum cleaners can be provided with a flexible hose, similar to a canister vacuum, to increase their functionality. To make upright vacuum cleaners with flexible hoses even more versatile, they often come with additional cleaning attachments, for example wand extensions, crevice tools, and cleaning brushes.

SUMMARY OF THE EMBODIMENTS OF THE INVENTION

It is an aspect of the present invention to provide a detachable tool caddy having accessory tools to be removable stored on a surface cleaner such as an upright vacuum.

The foregoing and/or other aspects of the present invention can be achieved by providing a tool caddy selectively connectable to a surface cleaner, the tool caddy comprising a base having a first accessory attachment feature, and a stem extending substantially perpendicular from the base and disposed substantially central to the base, the stem having a second accessory attachment feature.

The foregoing and/or other aspects of the present invention can be also achieved by providing a tool caddy selectively connectable to a surface cleaner, the tool caddy comprising a base having a first accessory attachment feature, and a stem extending substantially perpendicular from the base and disposed substantially central to the base, the stem having a first mounting slot, a second mounting slot, and second accessory attachment feature.

The foregoing and/or other aspects of the present invention can additionally be achieved by providing a tool caddy selectively connectable to a surface cleaner, the tool caddy comprising a base having a hose slot and a wand aperture, and a stem extending substantially perpendicular from the base and disposed substantially central to the base, the stem having a bottom opening, a top opening, a first arm, a second arm, a first clip, and a second clip.

The foregoing and/or other aspects of the present invention can further be achieved by providing a tool caddy selectively connectable to a surface cleaner, the tool caddy comprising a base having a hose slot and a wand aperture, and a stem extending substantially perpendicular from the base and disposed substantially central to the base, the stem having a bottom opening, a top opening, a first arm, a second arm, a first clip, a second clip, and flange extending proximate the top opening, wherein the top and bottom openings removably connect the tool caddy to a surface cleaner.

The foregoing and/or other aspects of the present invention can also be achieved by providing a combination surface cleaner and a removable tool caddy comprising a surface cleaner having a handle, a cord, an upper cord hook, and a lower cord hook, and a removable tool caddy having a base and a stem extending substantially perpendicular from the base and disposed substantially central to the base, the stem including a first opening and a flange for receiving the upper cord hook and a second opening for receiving the lower cord hook.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
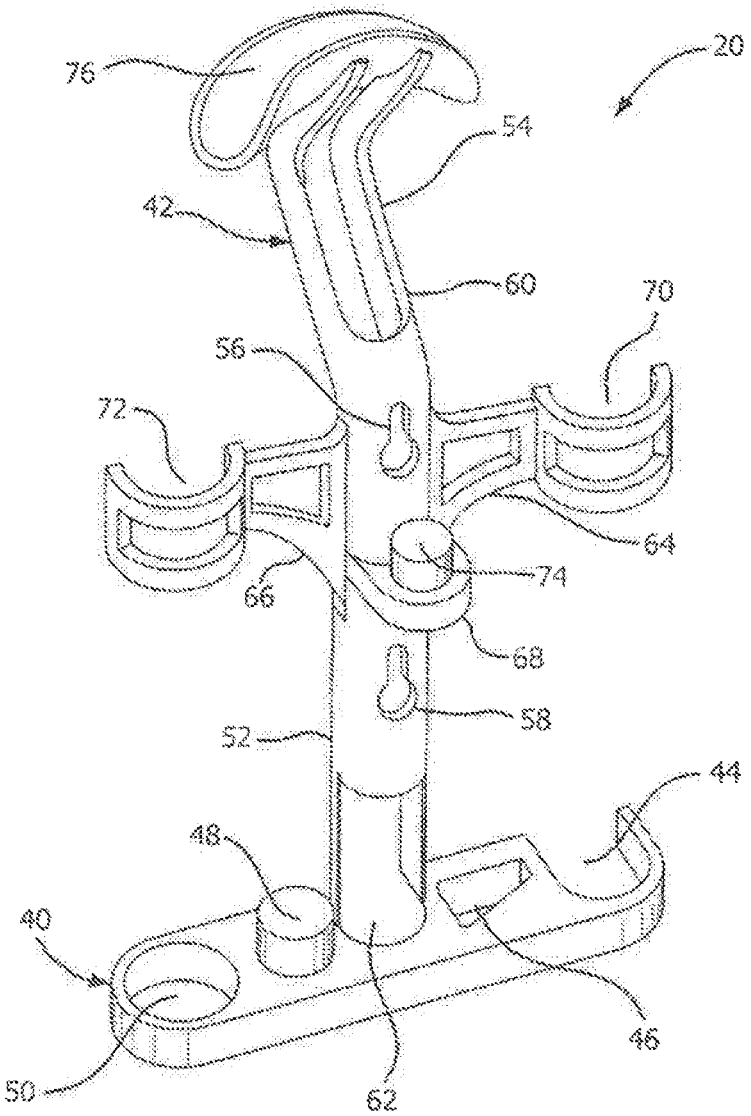
FIG. 1 is a perspective view of a tool caddy according to a first exemplary embodiment.
Figure 3:
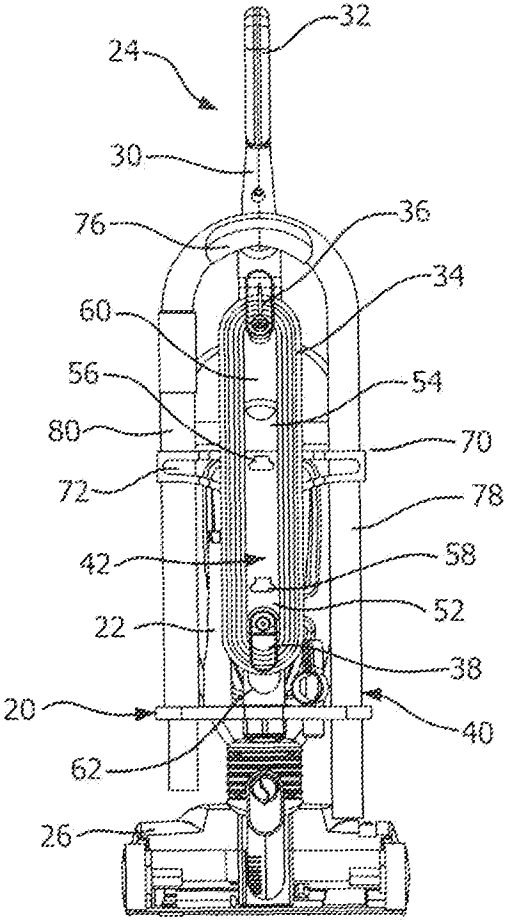
FIG. 3 is a rear elevational view of the tool caddy connected to the upright vacuum of FIG. 2.
Figure 2:
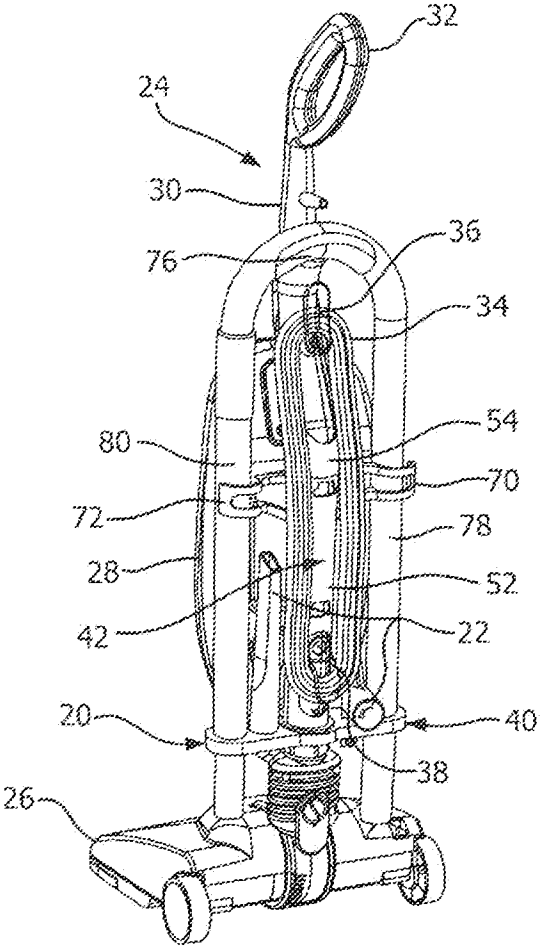
FIG. 2 is a rear perspective view of a tool caddy connected to an upright vacuum according to a second exemplary embodiment.
Figure 4:
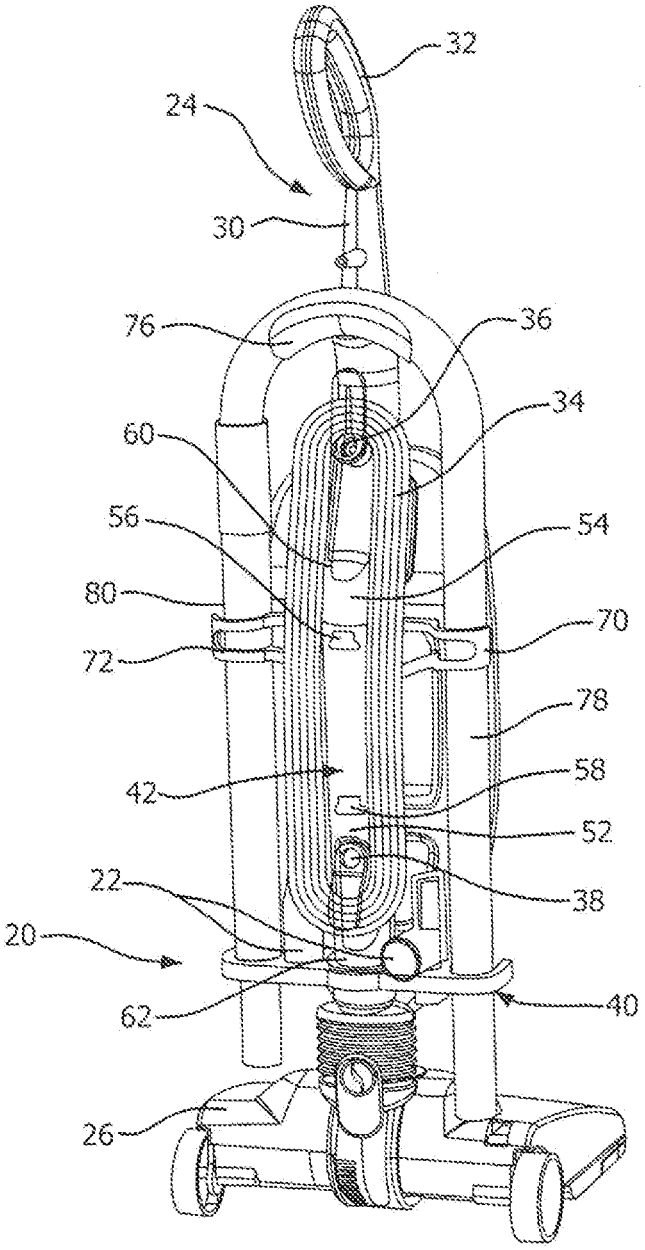
FIG. 4 is another rear perspective view of the tool caddy connected to the upright vacuum of FIG. 2.
Figure 5:
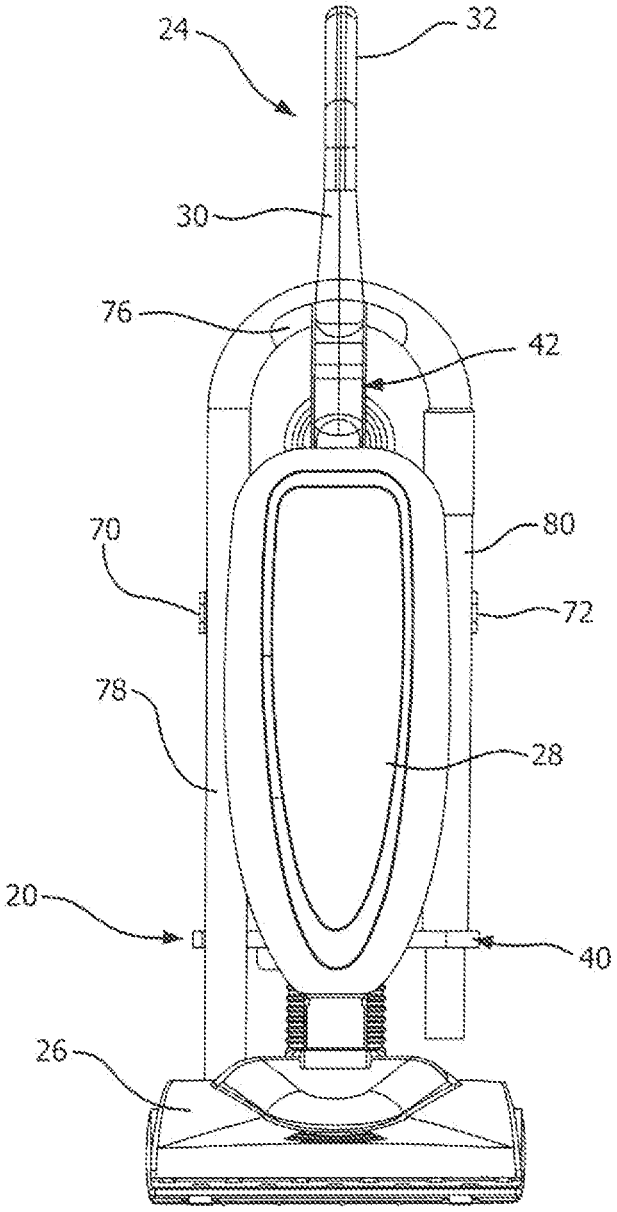
FIG. 5 is a front elevational view of the tool caddy connected to the upright vacuum of FIG. 2.
Figure 6:
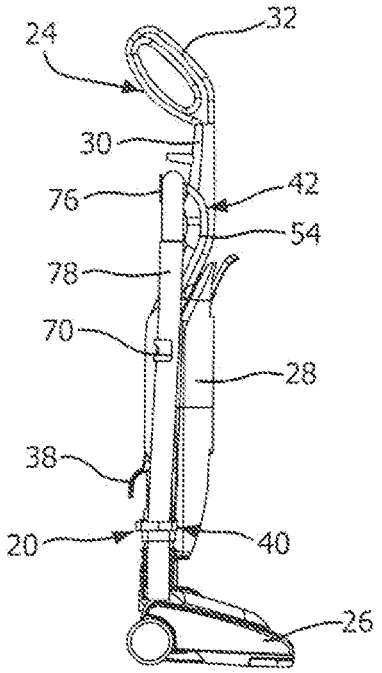
FIG. 6 is a left side elevational view of the tool caddy connected to the upright vacuum of FIG. 2.
Figure 7:
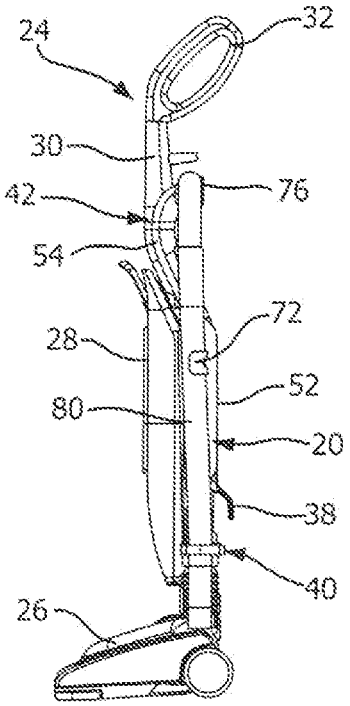
FIG. 7 is a right side elevational view of the tool caddy connected to the upright vacuum of FIG. 2.

Although additional cleaning accessories provide greater versatility for surface cleaners, they also increase the overall weight and bulkiness of the surface cleaners, making them difficult to lift and maneuver. In accordance with various exemplary embodiments, a detachable tool caddy 20 allows accessory tools 22, such as cleaning tools, to be removably stored on a surface cleaner, for example an upright vacuum 24.

FIGS. 1-10 show first and second exemplary embodiments of a tool caddy 20 that removably connects to a surface cleaner, for example an upright vacuum cleaner 24. As best shown in FIGS. 2-10, and according to various exemplary embodiments, the upright vacuum cleaner 24 includes a vacuum head 26, a bag housing 28, a handle 30, and a handle grip 32. A power cord 34 connects to the handle 30 and an upper cord hook 36 and a lower cord hook 38 extend from the handle 30 to support the cord 34 when not in use. It is understood by one of ordinary skill in the art in view of this disclosure to combine the tool caddy 20 with other configurations of upright vacuum cleaners 24 and surface cleaners.

The tool caddy 20 includes a base 40 and a stem 42 extending from the base 40. The base 40 and the stem 42 may be unitarily formed or separately formed and connected. In various exemplary embodiments, the base 40 and stem 42 may be made from a plastic, metal, ceramic, or composite material, or any combination thereof. In various exemplary embodiments, the base 40 and stem 42 are made from a polymer, or any other stiff, lightweight material.

The base 40 includes a substantially planar top surface extending orthogonal to the longitudinal axis of the stem 42. The base 40 has one or more accessory attachment features for receiving accessory tools 22. In the exemplary embodiments shown in FIGS. 1-10, the attachment features include a vacuum hose slot or hose pocket 44, an upholstery tool aperture or upholstery tool cradle 46, a crevice tool protrusion or crevice tool cradle 48, and a vacuum wand aperture or wand pocket 50. In various alternative embodiments, the base 40 may include greater or fewer accessory attachment features as well as different attachment features depending on the type of accessory tools 22 associated with a particular vacuum 24.

The stem 42 extends substantially perpendicular from the base 40. Substantially perpendicular is defined as 90°±10°. The stem 42 is also disposed substantially central relative to the base 40. Substantially central relative to the base 40 is defined as within ±10% from the center point of the base 40 based on the total length of the base 40. The stem 42 extends upwardly from the base 40 from a first end and includes a bottom portion 52 and a top portion 54. In various exemplary embodiments, the bottom portion 52 extends substantially vertically and the top portion 54 has one or more angled and/or curved sections to contour to the handle 30 of the vacuum 24.

Figure 13:
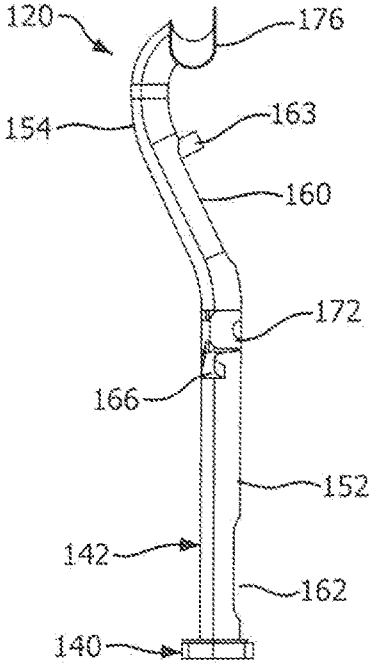
FIG. 13 is a left side elevational view of the tool caddy of FIG. 11.
Figure 14:
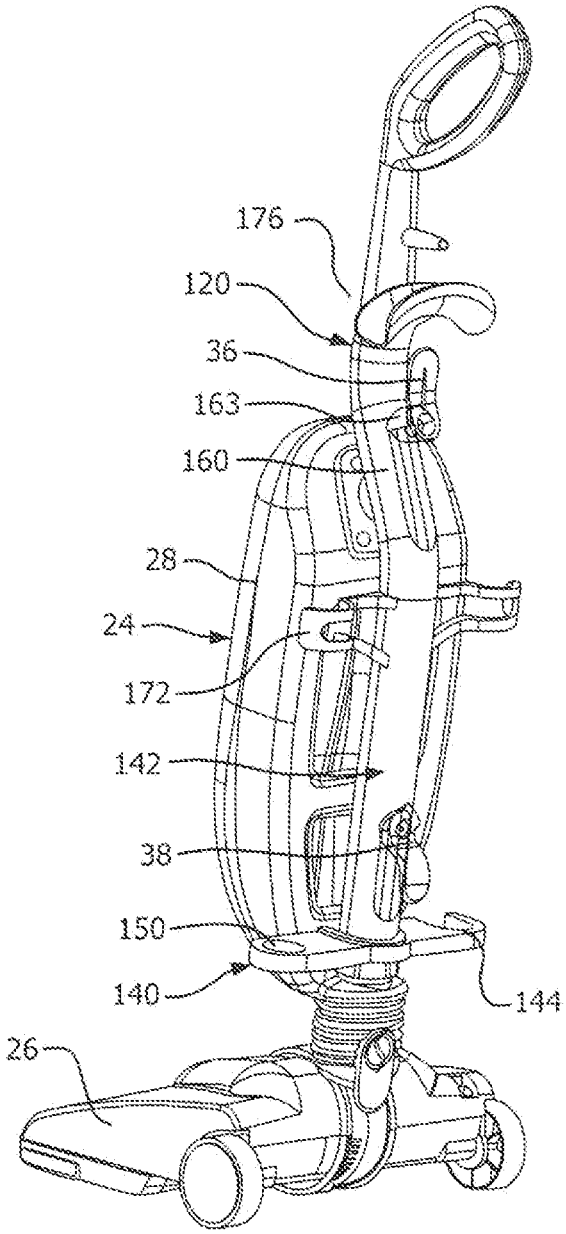
FIG. 14 is a rear perspective view of the tool caddy of FIG. 11 connected to an upright vacuum.
Figure 14A:
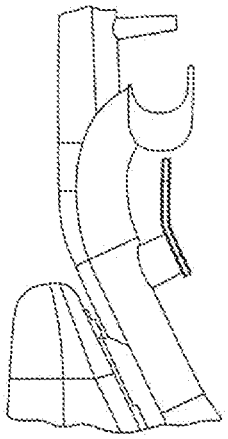
FIG. 14A is an enlarged, left side elevational view of the tool caddy and upright vacuum of FIG. 14, showing the upper cord hook connection.

The bottom and top portions 52, 54 are substantially semi-tubular in shape. For example, the bottom and top portions 52, 54 are rendered semi-tubular by being formed from a columnar, hollow tube that is longitudinally split at its circumference, as shown in FIGS. 1, 13 and 14A to create a curved recess to receive the cylindrical vacuum handle 30. As a simplified example, in a hollow column, a cross-sectional arc is absent or missing along the height or length of the column to form a semi-tubular shape. The splitting of the hollow tube to form the semi-tubular shape can occur at a plane offset from the longitudinal central axis so that the arc of the resulting semi-tubular shape extends beyond 180 degrees relative to the centerline. Preferably, the remaining arc of material is approximately 180-270 degrees. The semi-tubular shape, however, does not have to be columnar throughout, and can be nonlinear along various portions of its length. A substantially semi-tubular shape is defined to include a surface curvature within ±10% of a curvature of an ideal circular shape as understood by one of ordinary skill in the art. The shape, configuration and relative location of the top and bottom portions 52, 54, as well as the shape, configuration and relative location of the curved recess can vary depending on the associated vacuum handle 30.

The stem 42 includes one or more mounting features and one or more accessory attachment features. In the exemplary embodiments shown in FIGS. 1-10, the mounting features include a top mounting slot 56, a bottom mounting slot 58, a top opening 60, and a bottom opening 62. The top and bottom mounting slots 56, 58 engage protrusions extending from the vacuum handle 24. The top and bottom mounting slots 56, 58 are keyhole slots, although other types of mounting slots or apertures may also be used. The top and bottom openings 60, 62 provide a clearance to receive the upper and lower cord hooks 36, 38, respectively.

According to the exemplary embodiment shown in FIG. 1, the accessory attachment features include a first arm 64, a second arm 66, and a third arm 68 extending from the stem 42. The first arm 64 extends from the stem 42 in a first direction and includes a first clip 70, for example a semi-circular hose-receiving clip or hose rest, where the hose can rest. The second arm 66 extends from the stem 42 in a second direction substantially opposite the first arm 64 and includes a second clip or wand rest 72, for example a wand-receiving clip where the wand can rest. The third arm 68 extends from the stem 42 in a direction substantially orthogonal to the first and second arms 64, 66. A protrusion or brush tool cradle 74 extends upwardly from the third arm 68 to receive an accessory tool 22, for example a brush tool. A hose cradle 76 extends from the top of the stem 42. In various alternative embodiments, the stem 42 may include greater or fewer accessory attachment features as well as different attachment features depending on the type of accessory tools 22 associated with a particular vacuum 24.

The exemplary embodiment shown in FIGS. 2-10 omits the third arm 68 illustrated in the embodiment previously described and illustrated in FIG. 1. As best shown in FIGS. 2-7, when a user mounts the tool caddy 20 to the vacuum cleaner 24, the upper and lower cord hooks 36, 38 extend through the top and bottom openings 60, 62, respectively, and the vacuum cord 34 wraps around the upper and lower cord hooks 36, 38. The user can attach a vacuum hose 78, extension wand 80, and one or more additional accessory tools 22 to the tool caddy 20.

Figure 8:
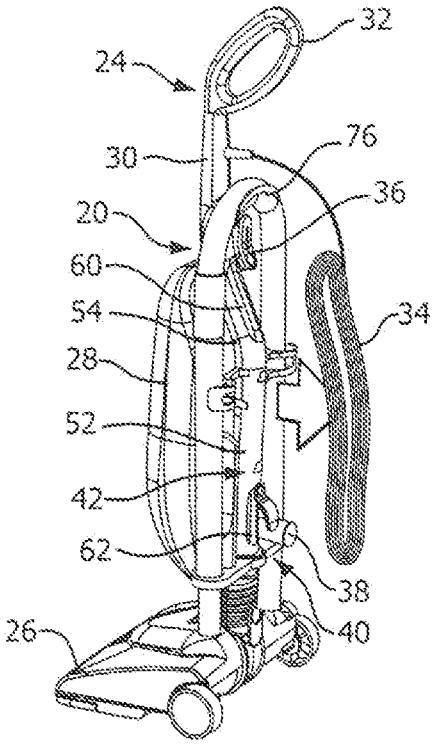
FIG. 8 is a rear perspective view of the tool caddy connected to the upright vacuum of FIG. 2, with the vacuum cord removed.
Figure 9:
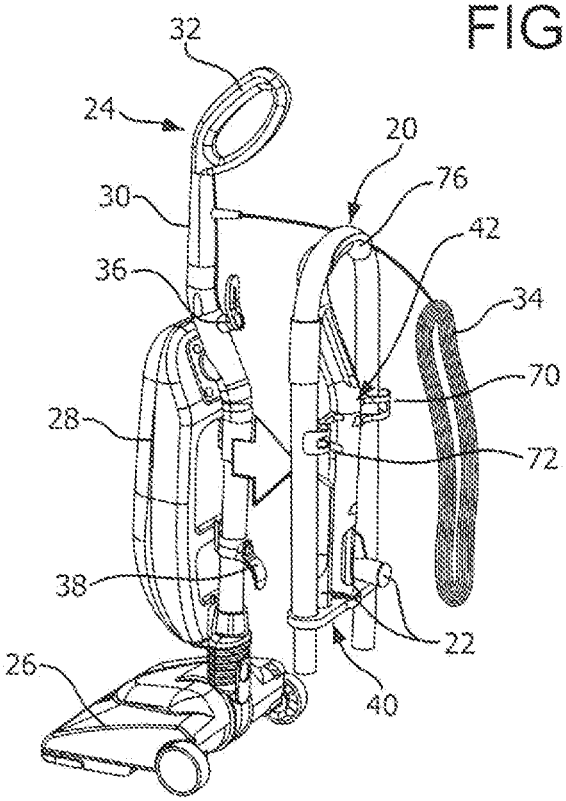
FIG. 9 is a rear perspective view of the tool caddy and the upright vacuum of FIG. 2, with the vacuum cord and tool caddy removed.
Figure 10:
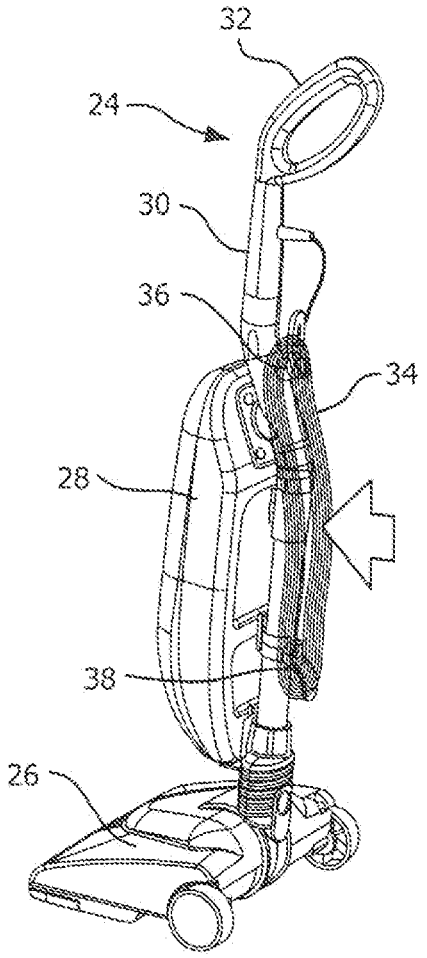
FIG. 10 is a rear perspective view of the upright vacuum of FIG. 2 with the tool caddy removed and the vacuum cord connected to upper and lower cord hooks.
Figure 11:
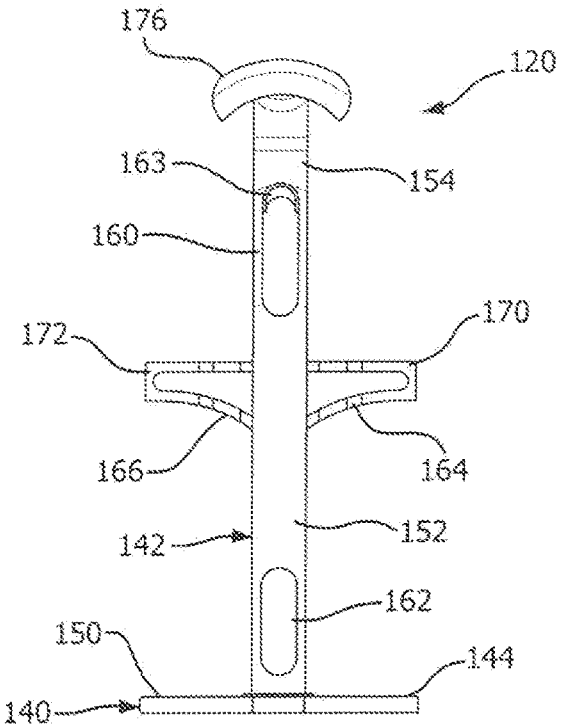
FIG. 11 is a rear elevational view of a tool caddy according to a third exemplary embodiment.
Figure 12:
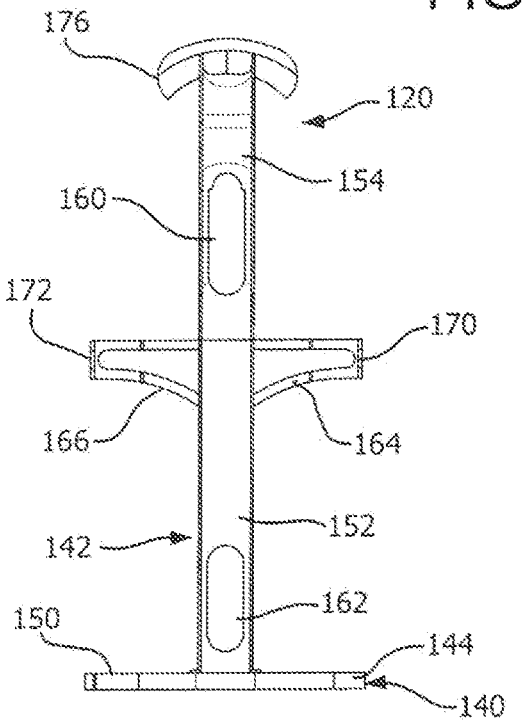
FIG. 12 is a front elevational view of the tool caddy of FIG. 11.

As best shown in FIGS. 8-10, to remove the tool caddy 20, a user removes the vacuum cord 34 from the upper and lower cord hooks 36, 38, the user rotates the upper cord hook 136, for example by 180 degrees (as explained subsequently in further detail), and then disengages the tool caddy 20 from the vacuum handle 30. Subsequently, the user can reattach the vacuum cord 34 to the upper and lower cord hooks 36, 38, or the vacuum 24 can be used as desired. After removal, the user can attach the hose 78, wand 80, and accessory tools 22 to the base 40 and/or stem 42. In various exemplary embodiments, the user can store or hang the tool caddy 20 in a closet, for example by a hook or hangar.

FIGS. 11-19 illustrate a third exemplary embodiment of a tool caddy 120 that removably connects to a surface cleaner, for example an upright vacuum cleaner 24. The tool caddy 120 includes a base 140 and a stem 142 extending upwardly from the base 140.

The base 140 includes a substantially planar top surface extending orthogonal to the longitudinal axis of the stem 142. The base 140 has one or more accessory attachment features for receiving cleaning accessories. In the exemplary embodiment shown in FIGS. 11-19, the attachment features include a slot 144 and an aperture 150, for example a vacuum hose slot 144 and a vacuum wand aperture 150. In various alternative embodiments, the base 140 can include greater or fewer accessory attachment features, as well as different attachment features depending on the type of accessory tools 22 associated with a particular vacuum 24.

The stem 142 extends upwardly from the base 140 from a first end, and includes a bottom portion 152 and a top portion 154. The bottom portion 152 extends substantially vertically and the top portion 154 has one or more angled and/or curved sections to contour to the handle 30 of the vacuum 24. In various exemplary embodiments, the bottom and top portions 152,154 are substantially semi-tubular in shape. Specifically, the bottom and top portions 152, 154 are formed from a tube that is split at its longitudinal axis to create a curved recess to receive the cylindrical vacuum handle 30, as shown in FIGS. 1, 13 and 14A, for example. As one skilled in the art will appreciate, the shape and configuration of the top and bottom portions 152, 154, as well as the shape and configuration of the recess of the stem 142 can vary depending on the associated vacuum handle 30 without departing from the scope of the present invention.

Figure 15:
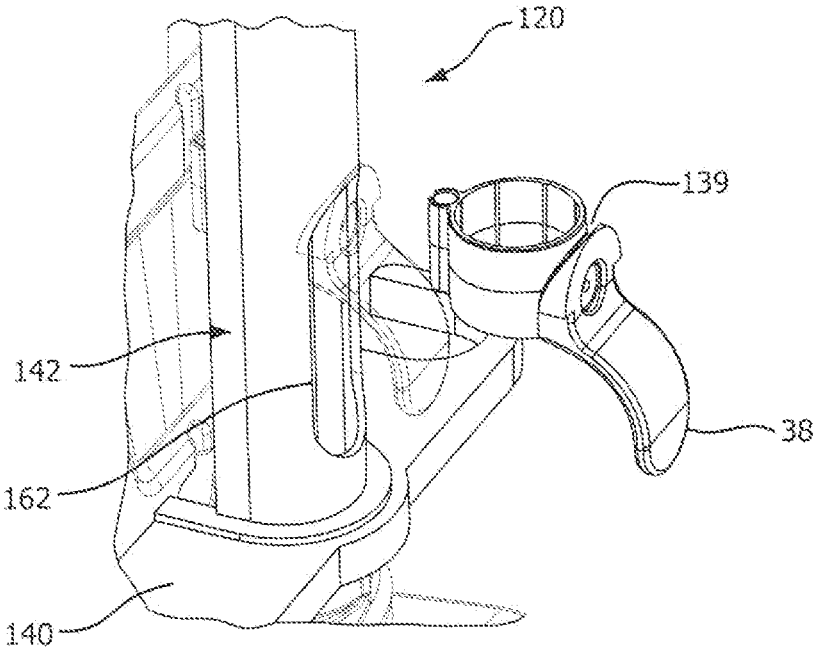
FIG. 15 is an enlarged, exploded, rear perspective view of the tool caddy and upright vacuum of FIG. 14, showing the lower cord hook connection.
Figure 16:
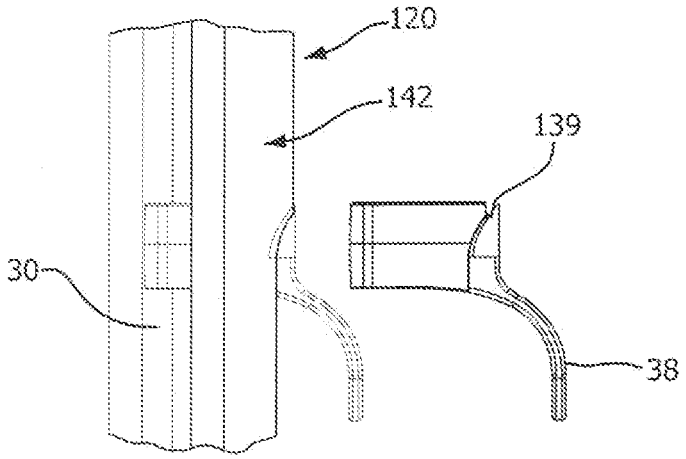
FIG. 16 is an enlarged, exploded, left side elevational view of the tool caddy and upright vacuum of FIG. 14, showing the lower cord hook connection.

The stem 142 includes one or more mounting features and one or more accessory attachment features. In the exemplary embodiment shown in FIGS. 11-19, the mounting features include a top opening 160 and a bottom opening 162 receiving the upper and lower cord hooks 36, 38, respectively. As best shown in FIGS. 14-14A, and according to various exemplary embodiments, a semi-circular flange 163 extends proximate the top opening 160 and receives a portion of the upper cord hook 36. The top portion of the tool caddy is secured at the upper cord hook 36. A notch in the lower cord hook 38 mates with an upper edge of the bottom opening 162 of the tool caddy to secure the bottom of the tool caddy. As best shown in FIGS. 15-16, and according to various exemplary embodiments, the lower cord hook 138 includes a slot 139 for receiving an upper edge of the bottom opening 162 in the tool caddy. The flange 163 secures the tool caddy 120 at the upper cord hook 36 and the slot 139 secures the tool caddy 120 at the lower cord hook 38.

According to the exemplary embodiment, the accessory attachment features include a first arm 164 and a second arm 166. The first arm 164 extends from the stem 142 in a first direction and includes a first clip 170, for example a semi-circular hose receiving clip. The second arm 166 extends from the stem 142 in a second direction substantially opposite the first arm 164 and includes a second clip 172, for example semi-circular wand receiving clip 172. In various alternative embodiments, the stem 142 can include additional accessory attachment features as well as different attachment features depending on the type of accessory tools 22 associated with a particular vacuum 24.

Figure 17:
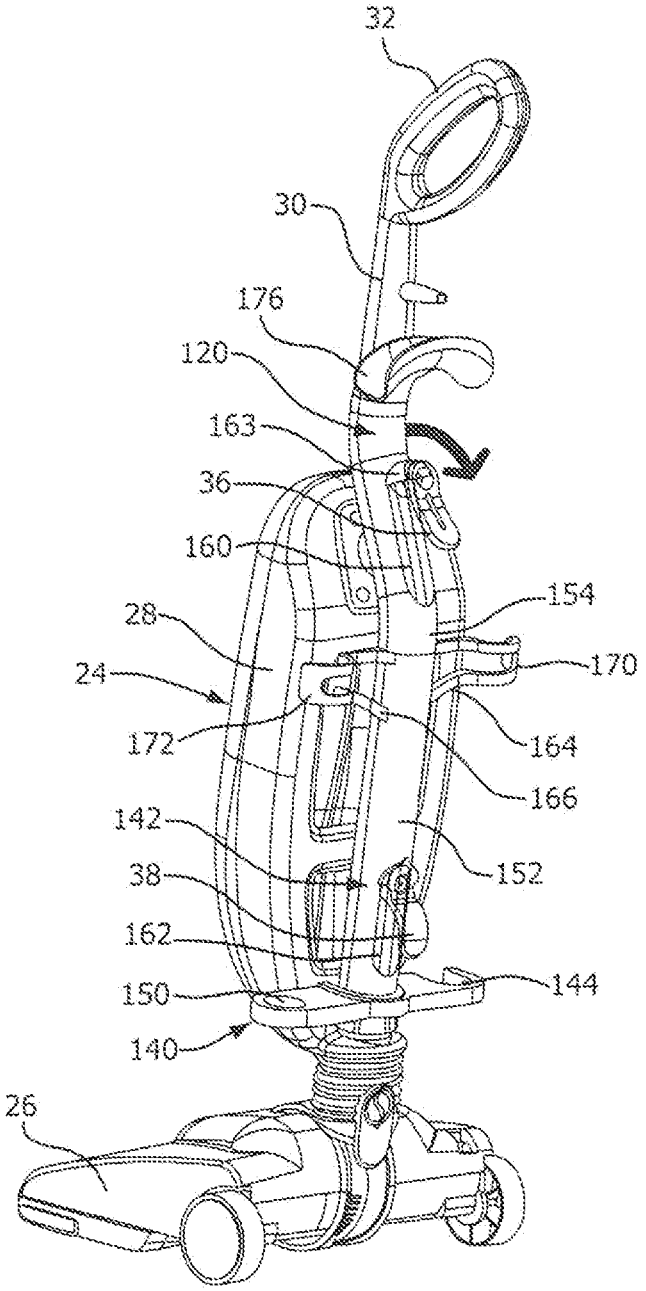
FIG. 17 is a rear perspective view of the tool caddy and upright vacuum of FIG. 14, with the upper hook rotated.
Figure 18:
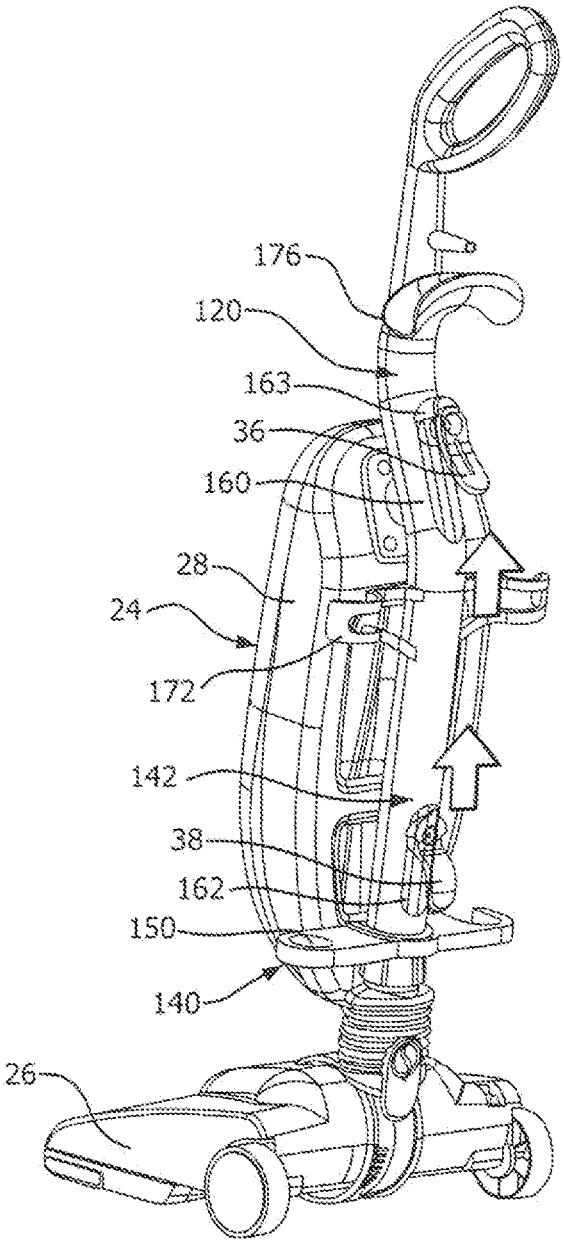
FIG. 18 is a rear perspective view of the tool caddy and upright vacuum of FIG. 14 with the upper hook rotated and the tool caddy disengaged from the upright vacuum.
Figure 18A:
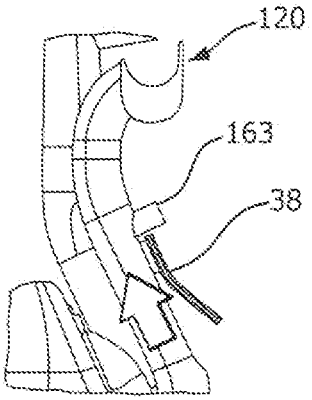
FIG. 18A is an enlarged, left side elevational view of the tool caddy and upright vacuum of FIG. 18, showing the disengagement of the upper cord hook.
Figure 18B:
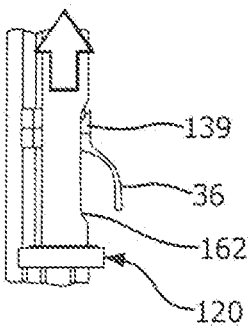
FIG. 18B is an enlarged, left side elevational view of the tool caddy and upright vacuum of FIG. 18, showing the disengagement of the lower cord hook.
Figure 19:
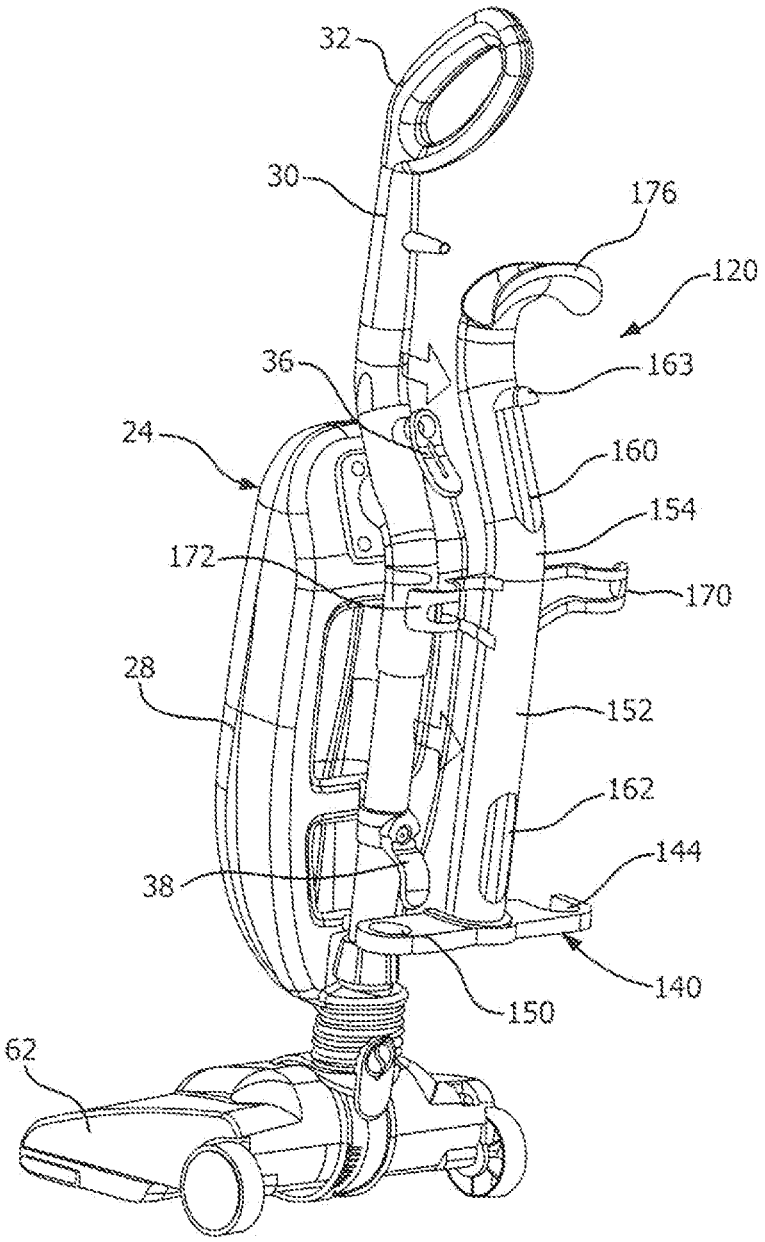
FIG. 19 is a rear perspective view of the tool caddy and upright vacuum of FIG. 14, with the tool caddy removed from the upright vacuum.

As best shown in FIGS. 17-19, to remove the tool caddy 120, the user rotates the upper cord hook 136, for example by 180 degrees, and lifts the tool caddy 120 up and away from the upper and lower cord hooks 36, 38. After removal, the user can store the tool caddy 120 with the hose 78, wand 80, and accessory tools 22 attached to the base 140 and/or stem 142. In various exemplary embodiments, a user can hang the tool caddy 120 in a closet, for example by a hook or hangar.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. For example, the size, shape and configuration of the tool caddies 20, 120 may be varied to accommodate different surface cleaners, and the size, shape, configuration, and type of mounting features and accessory attachment features may be varied to accommodate different surface cleaners and accessory tools 22. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

The invention claimed is:

1. A combination surface cleaner and a removable tool caddy comprising:

a surface cleaner having a handle, a cord, an upper cord hook, and a lower cord hook; and a removable tool caddy having a base and a stem extending substantially perpendicular from the base and disposed substantially central to the base, the stem including a first opening and a flange for receiving the upper cord hook and a second opening for receiving the lower cord hook.

2. The combination of claim 1, wherein the stem comprises a substantially semi-tubular member having a recess for receiving the handle.

3. The combination of claim 1, wherein the stem is contoured to match the handle.

4. The combination of claim 1, wherein the stem includes a first arm having a first clip, a second arm having a second clip, and a hose cradle.

5. The combination of claim 4, wherein the base includes a slot and an aperture.

6. The combination of claim 1, wherein engagement between the first opening and the upper cord hook and between the second opening and the lower cord hook secures the removable tool caddy to the surface cleaner.

7. The combination of claim 6, wherein upon rotation of the upper cord hook, the removable tool caddy is capable of mounting and dismounting to the handle of the surface cleaner.

* * * * *